United States Patent [19]

Baltz et al.

[11] Patent Number: 4,800,856

[45] Date of Patent: Jan. 31, 1989

[54] ABRASION RESISTANT ROLLER APPARATUS FOR INTERNAL COMBUSTION ENGINES

[75] Inventors: Gene F. Baltz, Lake Villa; Glenn R. Belec, Gurnee, both of Ill.

[73] Assignee: Outboard Marine Corporation, Waukegan, Ill.

[21] Appl. No.: 710,057

[22] Filed: Mar. 11, 1985

[51] Int. Cl.[4] ..... F24C 3/00

[52] U.S. Cl. ..... 123/413; 74/569

[58] Field of Search ..... 123/413, 90.51, 90.6; 74/569, 567, 55

[56] References Cited

U.S. PATENT DOCUMENTS

| | | | |
|---|---|---|---|
| 2,906,251 | 9/1959 | Soder, Jr. | 123/413 |
| 3,362,250 | 1/1968 | Bradley | 74/569 |
| 3,502,057 | 3/1970 | Thompson | 123/90.51 |
| 3,545,415 | 12/1970 | Mori | 123/90.51 |
| 3,552,219 | 1/1971 | Berg | 74/569 |
| 3,575,579 | 4/1971 | McGannon | 74/569 |
| 3,681,543 | 8/1972 | Schratz et al. | 74/569 |
| 3,915,129 | 10/1975 | Rust et al. | 74/569 |
| 4,031,777 | 6/1977 | Parks | 74/569 |
| 4,085,634 | 4/1978 | Sattler | 74/569 |
| 4,094,279 | 6/1978 | Kueny | 123/90.51 |
| 4,106,826 | 8/1978 | Marola et al. | 74/569 |
| 4,380,216 | 4/1983 | Kandler | 123/90.6 |
| 4,528,954 | 7/1985 | Slattery | 123/413 |
| 4,688,313 | 8/1987 | Keller | 74/567 |

FOREIGN PATENT DOCUMENTS

| | | | |
|---|---|---|---|
| 0165508 | 9/1983 | Japan | 123/90.51 |

*Primary Examiner*—Raymond A. Nelli

*Attorney, Agent, or Firm*—Michael, Best & Friedrich

[57] ABSTRACT

An engine apparatus comprising an internal combustion engine including a timer plate including thereon a throttle controlling cam, a carburetor mounted on the engine and including a throttle valve, and an actuating lever operably connected to the throttle valve, a cam follower assembly including a rocker arm pivotally mounted on the engine and having an end, a roller rotatably mounted on the rocker arm end and including an outer surface, and an abrasion resistant sleeve member on the roller outer surface, a spring biasing the cam follower assembly for engaging the sleeve member in rolling contact with the throttle controlling cam, and a link connecting the rocker arm to the actuating lever for actuating the throttle valve in response to movement of the timer plate.

21 Claims, 1 Drawing Sheet

ABRASION RESISTANT ROLLER APPARATUS FOR INTERNAL COMBUSTION ENGINES

BACKGROUND OF THE INVENTION

The invention relates to internal combustion engines, and, more particularly, to cam following roller apparatus for internal combustion engines. Even more particularly, the invention relates to roller apparatus following a cam attached to a timer plate and operably connected to a throttle valve for actuation thereof.

It is known to use plastic rollers which rotate about a pin and which have rolling contact with a cam surface. These plastic rollers reduce friction between the cam surface and the cam follower. However, such plastic rollers tend to wear out due to abrasion from friction.

It is also known to use rubber rollers as cam followers. Rubber rollers are fairly resilient but tend to take a set or assume a different shape when subjected to constant forces. Furthermore, rubber rollers have relatively low abrasion resistance.

Attention is directed to Soder U.S. Pat. No. 2,906,251, issued Sept. 29, 1959, which discloses an engine apparatus including a cam fixed to a timer plate, and a cam follower operably attached to a throttle valve, the cam follower including a roller biased against the cam.

SUMMARY OF THE INVENTION

The invention provides an engine apparatus comprising an internal combustion engine including a timer plate including thereon a throttle controlling cam, a carburetor mounted on the engine and including a throttle valve, and an actuating lever operably connected to the throttle valve, a cam follower assembly including a rocker arm pivotally mounted on the engine and having an end, a roller rotatably mounted on the rocker arm end and including an outer surface, and an abrasion resistance sleeve member on the roller outer surface, means biasing the cam follower assembly for engaging the sleeve member in rolling contact with the throttle controlling cam, and means connecting the rocker arm to the actuating lever for actuating the throttle valve in response to movement of the timer plate.

In one embodiment, the sleeve member is resilient and has memory.

In one embodiment, the sleeve member is made of polyurethane.

In one embodiment, the roller includes a bore, and the apparatus further comprises an abrasion resistant bushing in the bore and adapted to receive and rotate about the end of the rocker arm.

In one embodiment, the bushing is resilient and has memory.

In one embodiment, the bushing is made of polyurethane.

In one embodiment, the roller includes means for retaining the sleeve member on the outer surface of the roller.

In one embodiment, the roller has opposite ends, and the retaining means includes shoulder means on the opposite ends of the roller.

The invention also provides a roller apparatus adapted to have rolling contact with a cam surface and to rotate about a pin, the roller apparatus comprising a roller adapted to rotate about the pin and including an outer surface, and an abrasion resistant sleeve member on the outer surface of the roller and being adapted to have rolling contact with the cam surface.

The invention also provides an apparatus comprising a support, a cam member mounted on the support and including a cam surface, a cam follower assembly including a pivot member movably mounted on the support and adapted to be connected to a device for actuation of the device in response to pivot member movement, a roller rotatably mounted on the pivot member and including an outer surface, and an abrasion resistant sleeve member on the outer surface of the roller, and means biasing the cam follower assembly for engaging the sleeve member in rolling contact with the cam surface.

A principal feature of the invention is the provision of an abrasion resistant sleeve member on the outer surface of the roller. This provides a significant increase in durability over prior conventional plastic rollers.

Another principal feature of the invention is the provision of a follower roller with a sleeve member which is resilient and has memory.

Another principal feature of the invention is the provision of a sleeve member which is made of polyurethane and which forms part of a follower roller.

Various other features and advantages of the invention are set forth in the following detailed description, claims, and drawings.

Figure 1:
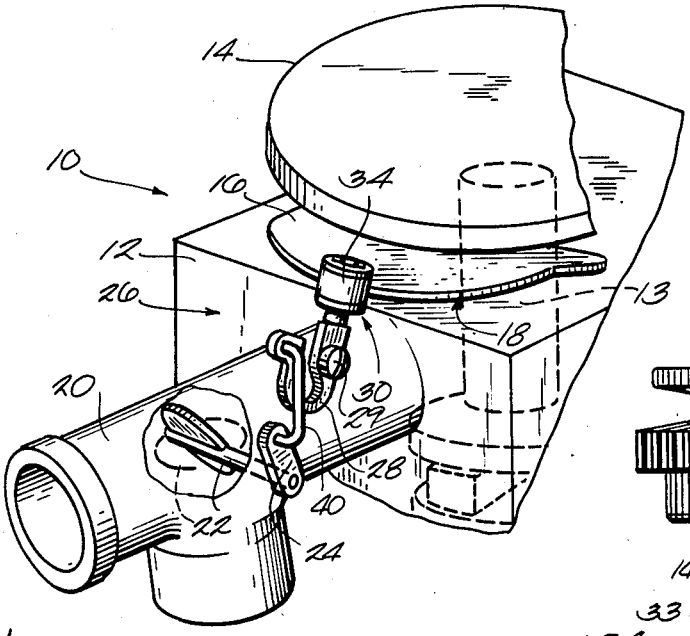
FIG. 1 is a perspective view of an engine apparatus embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An engine apparatus 10 embodying the invention is illustrated in the drawings. The engine apparatus 10 comprises an internal combustion engine 12 including a crankshaft 13, a timer plate 14, and a throttle controlling cam 16 mounted on the timer plate 14 for common movement therewith. In an alternative embodiment, the throttle controlling cam 16 can be part of the timer plate 14.

The throttle controlling cam 16 has a cam surface 18 and includes a portion of rapidly increasing radius and a portion which is nearly concentric with the axis of the crankshaft 13. The timer plate 14 is rotated counterclockwise as viewed in FIG. 1 to advance the spark timing, and the throttle controlling cam 16 rotates along with the timer plate 14.

The engine apparatus 10 also comprises a carburetor 20 mounted on the engine 12 and including a throttle valve 22, and an actuating lever 24 operably connected to the throttle valve 22. Pivotal movement of the actuating lever 24 controls opening and closing of the throttle valve 22.

A similar arrangement is disclosed in Soder U.S. Pat. No. 2,906,251, issued Sept. 29, 1959, which is incorporated herein by reference.

The engine apparatus 10 further comprises a cam follower assembly 26 including a pivot member, pivot pin or rocker arm 28 pivotally mounted on the engine 12 by a bolt 29 and having first and second ends. The cam follower assembly 26 also includes a roller 30 rotatably mounted on the first end of the rocker arm 28. The roller 30 includes an outer surface, and an inner bore 32 receiving the end of the rocker arm 28. In the illustrated construction, the first end of the rocker arm 28 includes a shoulder, and the bore 32 includes a step complementary with and engaging the shoulder so that the roller 30 is axially supported by the rocker arm 28. The roller 30 is secured on the end of the rocker arm 28 by a pin 33.

The cam follower assembly 26 further includes an abrasion resistant sleeve member 34 on the outer surface of the roller 30. In the preferred embodiment, the sleeve member 34 is resilient and has memory. Preferably, the sleeve member 34 is made of polyurethane.

In the preferred embodiment, the roller 30 includes means for retaining the sleeve member 34 on the outer surface of the roller 30. While various suitable retaining means can be employed, in the illustrated construction, the retaining means includes shoulder means 36 on the opposite ends of the roller 30.

Figure 2:
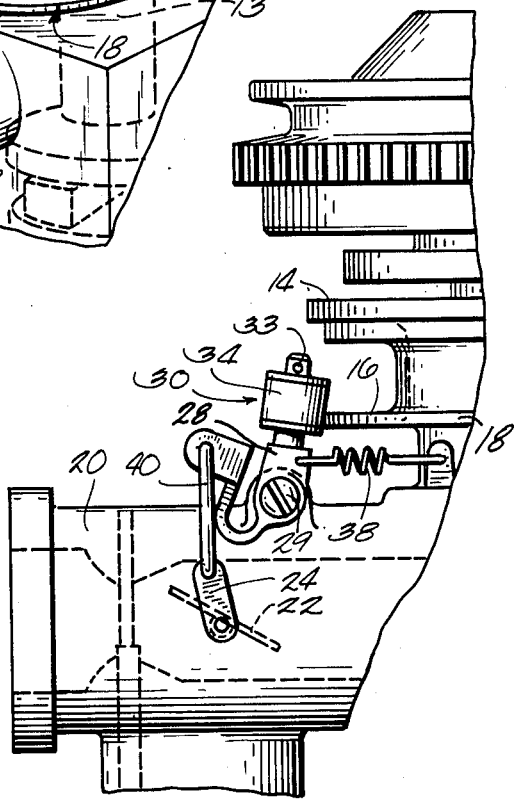
FIG. 2 is a side elevational view of the engine apparatus.
Figure 3:
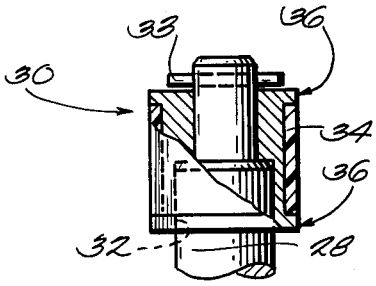
FIG. 3 is an enlarged, cross-sectional view of the roller and sleeve member.

The engine apparatus 10 further comprises means biasing the cam follower assembly 26 for engaging the sleeve member 34 in rolling contact with the cam surface 18 of the throttle controlling cam 16. While various suitable biasing means can be used, in the preferred embodiment, the biasing means includes a tension spring 38 connected between the rocker arm 28 and the engine 12. This spring 38 biases the rocker arm 28 clockwise as shown in FIG. 2, thereby engaging the sleeve member 34 in rolling contact with the cam surface 18 of the throttle controlling cam 16.

The engine apparatus 10 further comprises means connecting the second end of the rocker arm 28 to the actuating lever 24 for actuating the throttle valve 22 in response to movement of the rimer plate 14. While various suitable connecting means can be employed, in the illustrated construction, the connecting means includes a connecting link 40 between the second end of the rocker arm 28 and the actuating lever 24.

The engine apparatus 10 operates as follows. The tension spring 38 biases the rocker arm 28 so that the sleeve member 34 is in rolling contact with the throttle controlling cam 16, which moves with the timer plate 14. Counterclockwise rotation of the timer plate 14 (advancing the spark timing) causes counterclockwise rotation of the throttle controlling cam 16, which in turn pivots the rocker arm 28 counterclockwise as viewed in FIG. 2. This counterclockwise movement of the rocker arm 28 opens the throttle valve 22 via the connecting link 40 and the actuating lever 24.

Figure 4:
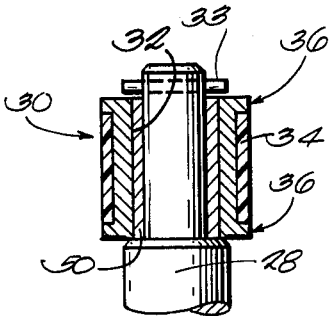
FIG. 4 is an enlarged, cross-sectional view of an alternative construction of the roller apparatus.

Illustrated in FIG. 4 is an alternative embodiment of the invention. Components common with the apparatus 10 of the preferred embodiment are given the same reference numerals. In the alternative embodiment, the apparatus further comprises an abrasion resistant bushing 50 between the pivot pin or rocker arm 28 and the roller 30. The bushing 50 is in the bore in the roller 30 and receives and rotates about the pin 28. In this embodiment, the rocker arm 28 includes a shoulder engaging the lower end of the roller 30, and the inner bore 32 has a constant diameter. Preferably, the bushing 50 is also made of polyurethane.

Various other features and advantages of the invention are set forth in the following claims.

We claim:

1. An engine apparatus comprising an internal combustion engine including a timer plate including thereon a throttle controlling cam, a carburetor mounted on said engine and including a throttle valve, and an actuating lever operably connected to said throttle valve, a cam follower assembly including a rocker arm pivotally mounted on said engine and having an end, a roller rotatably mounted on said rocker arm end and including an outer surface, and an abrasion resistant sleeve member on said roller outer surface, said sleeve member being resilient and having memory, means biasing said cam follower assembly for engaging said sleeve member in rolling contact with said throttle controlling cam, and means connecting said rocker arm to said actuating lever for actuating said throttle valve in response to movement of said timer plate.

2. An engine apparatus as set forth in claim 1 wherein said sleeve member is made of polyurethane.

3. An engine apparatus as set forth in claim 1 wherein said roller includes a bore, and wherein said apparatus further comprises an abrasion resistant bushing in said bore and adapted to receive and rotate about the pivot pin.

4. An engine apparatus as set forth in claim 3 wherein said bushing is resilient and has memory.

5. An engine apparatus as set forth in claim 3 wherein said bushing is made of polyurethane.

6. An engine apparatus as set forth in claim 1 wherein said roller includes means for retaining said sleeve member on said outer surface of said roller.

7. An engine apparatus as set forth in claim 6 wherein said roller has opposite ends, and wherein said retaining means includes shoulder means on said opposite ends of said roller.

8. An apparatus comprising a support, a cam member mounted on said support and including a cam surface, and a cam follower assembly including a pivot member movably mounted on said support and adapted to be connected to a device for actuation of the device in response to pivot member movement, a roller rotatably mounted on said pivot member and including an outer surface, and an abrasion resistant sleeve member on said outer surface of said roller, said sleeve member being resilient and having memory, and means biasing said cam follower assembly for engaging said sleeve member in rolling contact with said cam surface.

9. An apparatus as set forth in claim 8 wherein said sleeve member is made of polyurethane.

10. An apparatus as set forth in claim 8 wherein said roller includes a bore, and wherein said apparatus further comprises an abrasion resistant bushing in said bore and adapted to receive and rotate about said pivot pin.

11. An apparatus as set forth in claim 10 wherein said bushing is resilient and has memory.

12. An apparatus as set forth in claim 10 wherein said bushing is made of polyurethane.

13. An apparatus as set forth in claim 8 wherein said roller includes means for retaining said sleeve member on said outer surface of said roller.

14. An apparatus as set forth in claim 13 wherein said roller has opposite ends, and wherein said retaining means includes shoulder means on said opposite ends of said roller.

15. A roller apparatus adapted to have rolling contact with a cam surface and to rotate about a pin, said roller apparatus comprising a roller adapted to rotate about the pin and including an outer surface, and an abrasion resistant sleeve member on said outer surface of said roller, said sleeve being resilient, having memory, and being adapted to have rolling contact with the cam surface.

16. A roller apparatus as set forth in claim 15 wherein said sleeve member is made of polyurethane.

17. A roller apparatus as set forth in claim 15 wherein said roller includes a bore, and wherein said apparatus further comprises an abrasion resistant bushing in said bore and adapted to receive and rotate about the pin.

18. A roller apparatus as set forth in claim 17 wherein said bushing is resilient and has memory.

19. A roller apparatus as set forth in claim 17 wherein said bushing is made of polyurethane.

20. A roller apparatus as set forth in claim 15, wherein said roller includes means for retaining said sleeve member on said outer surface of said roller.

21. A roller apparatus as set forth in claim 20 wherein said roller has opposite ends, and wherein said retaining means includes shoulder means on said opposite ends of said roller.

* * * * *